US009644279B2

(12) United States Patent
Omachi et al.

(10) Patent No.: US 9,644,279 B2
(45) Date of Patent: May 9, 2017

(54) ZINC-NICKEL ALLOY PLATING SOLUTION AND PLATING METHOD

(71) Applicant: Nippon Hyomen Kagaku Kabushiki Kaisha, Tokyo (JP)

(72) Inventors: Mitsuhiro Omachi, Kanagawa (JP); Atsushi Kaneko, Kanagawa (JP); Satoshi Ito, Kanagawa (JP)

(73) Assignee: Nippon Hyomen Kagaku Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/779,344

(22) PCT Filed: Mar. 24, 2014

(86) PCT No.: PCT/JP2014/058115
§ 371 (c)(1),
(2) Date: Sep. 23, 2015

(87) PCT Pub. No.: WO2014/157105
PCT Pub. Date: Oct. 2, 2014

(65) Prior Publication Data

US 2016/0068984 A1 Mar. 10, 2016

(30) Foreign Application Priority Data

Mar. 27, 2013 (JP) ..... 2013-067377

(51) Int. Cl.
*C25D 3/56* (2006.01)
*C25D 5/36* (2006.01)
*C25D 5/48* (2006.01)

(52) U.S. Cl.
CPC ..... *C25D 3/565* (2013.01); *C25D 5/36* (2013.01); *C25D 5/48* (2013.01)

(58) Field of Classification Search
CPC ..... C25D 3/562; C25D 3/565
USPC ..... 205/246, 259
See application file for complete search history.

(56) References Cited

U.S. PATENT DOCUMENTS 3,691,027 A * 9/1972 Hartford ..... C25D 3/565 205/148
4,488,942 A * 12/1984 Martin ..... C25D 3/565 205/245
4,861,442 A 8/1989 Nishihama et al.
9,322,107 B2 4/2016 Brunner et al.
2005/0133376 A1* 6/2005 Opaskar ..... C25D 3/565 205/246
2005/0189231 A1* 9/2005 Capper ..... C25D 3/565 205/246
2012/0160698 A1 6/2012 Brunner et al.

FOREIGN PATENT DOCUMENTS

DE 2363521 A1 6/1975
EP 529922 A1 3/1993
EP 1719826 A1 11/2006
EP 2292679 A1 3/2011
EP 2706132 A1 3/2014
FR 2906542 A1 4/2008
JP 2007-525598 A 9/2007
JP 2013-014833 A 1/2013
JP 2013-032571 A 2/2013
JP 2013-503968 A 2/2013
JP 2013032571 A * 2/2013 ..... C25D 3/56
WO WO-2013/018633 A1 2/2013

OTHER PUBLICATIONS

Stevanovic et al., "Hydrogen Evolution at Zn—Ni Alloys," Electrochimica Acta (no month, 1998), vol. 43, No. 7, pp. 705-711.*
Muller et al., "Complexing Agents for a Zn—Ni Alkaline Bath," Journal of Electroanalytical Chemistry (no month, 2002), vol. 519, pp. 85-92.*
International Preliminary Report on Patentability from International Application No. PCT/JP2014/058115 dated Sep. 28, 2015.
Search Report in International Application No. PCT/JP2014/058115 dated Apr. 28, 2014.
Partial Supplementary European Search Report in EP Application No. 14773006.3 dated Oct. 27, 2016, 7 pages.
Search Report in European Application No. 14773006.3 dated Feb. 8, 2017, 19 pages.

* cited by examiner

*Primary Examiner* — Edna Wong
(74) *Attorney, Agent, or Firm* — Marshall, Gerstein & Borun LLP

(57) ABSTRACT

To provide a high-nickel plating bath which is weakly acidic and can stably form a plating film having a nickel content of 11 to 19% (preferably 12 to 18%) even at a current density of 3 A/dm$^2$ or more. An acidic zinc-nickel alloy electroplating solution which contains an amine compound represented by the formula $H_2N$—R1-R2 {wherein: R1 is $[(CH_2)_M$—$NH]_L$ or $(CH_2)_N$; R2 is H, $NH_2$, or R3; R3 is an alkanol or alkoxyl group having 1, 2, 3, 4, or 5 carbon atoms; L is 2, 3, 4, or 5; M is 2, 3, 4, or 5; and N is 3, 4, or 5}.

14 Claims, No Drawings

ZINC-NICKEL ALLOY PLATING SOLUTION AND PLATING METHOD

The present invention relates to a zinc-nickel alloy plating solution and a plating method using the plating solution. More specifically, the invention relates to acidic zinc-nickel alloy electroplating solution and an electroplating method using the plating solution.

BACKGROUND ART

Steel that is used in, for example, automobile parts and construction materials, is a metal apt to rust. Zinc plating and alloy plating mainly using zinc have been widely used for a long time as a method for protecting such metals apt to rust from corroding. In particular, among zinc alloy plating, zinc-nickel alloy plating has been increasingly widely used for automobile parts because of its excellent corrosion resistance. In a specific method of this zinc-nickel alloy plating, a plating solution dissolving a compound of zinc and nickel in a weak acid or alkali aqueous solution is subjected to direct current electrolysis to deposit the alloy on the cathode.

Zinc-nickel alloy plating has been applied to mass production parts for several decades. In the early period of such a history, mostly used was a bath providing a proportion of nickel in plating film of about 6% to 10% by mass (hereinafter, referred to as low-nickel-bath). Thereafter, a bath having a proportion of nickel of 11% to 19% by mass, more typically 12% to 18% by mass, (hereinafter, referred to as high-nickel-bath) has been developed. Application of this high-nickel-bath has been increasing because of its further excellent corrosion resistance.

Most of the high-nickel-baths that are currently practically used are alkali baths, and acid baths are rarely used. The reason thereof is, for example, that an alkali high-nickel-bath can stably provide plating films with the above-mentioned range of proportion of nickel and can achieve high adhesion to plating films. Accordingly, alkali high-nickel-baths are employed for, for example, automobile parts.

As an example of zinc plating using such an alkali high-nickel-bath, Patent Literature 1 discloses a plating solution containing an amine having four or more nitrogen atoms in one molecule.

However, the alkali high-nickel-bath has some disadvantages. For example, the alkali high-nickel-bath has a low current efficiency in plating and has a low plating rate. In addition, long time use thereof increases the carbonate content in the plating solution to further decrease the current efficiency, and the amount of nickel in the plating film becomes too high, exceeding the above-mentioned range, to lose the sacrificial rust resistant effect on iron materials. As a result, the life-span of the plating solution is restricted. In addition, a ratio of nickel higher than the above-mentioned range in a plating film deteriorates the adhesion of the plating.

In contrast, a weak acid bath gives a high current efficiency and has a high plating rate. In addition, accumulation of carbonate does not occur, unlike alkali baths. For example, Patent Literature 2 discloses a zinc-nickel trialloy plating solution containing an amine compound.

CITATION LIST

Patent Literature

[Patent Literature 1] Japanese Unexamined Patent Application Publication No. 2013-14833

[Patent Literature 2] National Publication of International Patent Application No. 2007-525598

SUMMARY OF INVENTION

Technical Problem

Use of a weak acid high-nickel bath, however, causes another problem. That is, a change in the current density during plating causes a large change in the ratio of nickel in the film. As a result, a current density of 3 A/dm$^2$ or more may increase the ratio of nickel in the film to a level higher than the above-mentioned range. A ratio of nickel higher than the above-mentioned range decreases the adhesion of the film and causes detachment of the film.

In electroplating of, for example, an automobile part having a complicated shape, a variation in current density occurs at various portions of a part. Accordingly, it is difficult to restrain the current density to 3 A/dm$^2$ or less at every portion of the surface of the part. If the whole current density is forcibly restrained, the plating rate is extremely reduced to significantly decrease the industrial utility value.

An object of the present invention, which has been made in view of the above-described circumstances, is to provide a weak acid high-nickel-bath that can stably give a plating film with a nickel proportion of 11% to 19% by mass (more preferably 12% to 18% by mass) even at a current density of 3 A/dm$^2$ or more, and thereby to provide a plating solution giving a high plating rate and excellent corrosion resistance and adhesion and giving a high industrial utility value.

Solution to Problem

The present inventors have thought an increase in ratio of nickel over the desired range at a current density of 3 A/dm$^2$ or more occurs according to the following theory. Zinc ions and nickel ions in a plating solution become into hydroxides in the process of deposition of plating (Kinzoku Hyomen Gijutsu (Journal of the Metal Finishing Society of Japan), Vol. 31, No. 10, Alloy Plating, 1980). In particular, at a high current density of 3 A/dm$^2$ or more, the pH level extremely increases to excessively deposit hydroxides originating from zinc ions and nickel ions, which deteriorates the corrosion resistance and adhesion of the plating film. Accordingly, the present inventors have investigated in order to find an additive that forms complex salts with zinc and nickel to restrain excess production of hydroxides of zinc and nickel even at a high current density of 3 A/dm$^2$ or more. As a result, the present inventors have found that as a method for preventing an increase in ratio of nickel over the desired range at a current density of 3 A/dm$^2$ or more in a weak acid bath, addition of a specific coordinate compound (a specific amine and alkanolamine) of nickel to a plating solution converts nickel ions into complex ions to adjust the ratio of nickel in a plating film to 11% to 19% by mass, and have accomplished the present invention.

The aspects of the present invention based on the above-mentioned idea are as follows.

(I) An acidic zinc-nickel alloy electroplating solution, the plating solution comprising:

(1) a zinc ion;
(2) a nickel ion;
(3) an electroconductive salt;
(4) a pH buffering agent; and
(5) an amine compound represented by the following Formula:

$H_2N—R1-R2$ where,
R1 represents $[(CH_2)_M—NH]_L$ or $(CH_2)_N$;
R2 represents H, $NH_2$, or R3;
R3 represents an alkanol or alkoxyl group having 1, 2, 3, 4, or 5 carbon atoms;
L is 2, 3, 4, or 5;
M is 2, 3, 4, or 5; and
N is 3, 4, or 5.

(II) The plating solution according to Aspect (I), wherein the plating solution has a pH of 4 to 6.

(III) The plating solution according to Aspect (I) or (II), wherein a total content of the amine compound is 5 to 50 g/L.

(IV) The plating solution according to any one of Aspects (I) to (III), wherein R1 represents $[(CH_2)_M—NH]_L$.

(V) The plating solution according to any one of Aspects (I) to (III), wherein R1 represents $(CH_2)_N$.

(VI) The plating solution according to any one of Aspects (I) to (III), wherein the amine compound is at least one selected from the group consisting of propylamine, butylamine, diethylenetriamine, triethylenetetramine, and tetraethylenepentamine; and hydroxyethanol adducts, hydroxypropanol adducts, and ethoxy adducts of these amines.

(VII) The plating solution according to any one of Aspects (I) to (VI), wherein a total content of the zinc ion is 10 to 60 g/L, and a total content of the nickel ion is 10 to 60 g/L.

(VIII) The plating solution according to any one of Aspects (I) to (VII), wherein a total content of the electroconductive salt is 100 to 280 g/L, and the electroconductive salt is potassium chloride and/or ammonium chloride.

(IX) The plating solution according to any one of Aspects (I) to (VIII), wherein a total content of the pH buffering agent is 5 to 55 g/L, and the pH buffering agent is at least one selected from the group consisting of boric acid, acetic acid, citric acid, ascorbic acid, and tartaric acid and ammonium salts, sodium salts, and potassium salts of these acids.

(X) The plating solution according to any one of Aspects (I) to (IX), further comprising a brightening agent and/or smoothing agent.

(XI) The plating solution according to Aspect (X), wherein the brightening agent and/or smoothing agent is at least one selected from the following compounds:

(i) natural organic compounds that are at least one selected from gelatin, glue, and peptone;
(ii) surfactants that are at least one selected from polyoxyethylene polyoxypropylene block polymers, alkyl naphthalene EO adducts, β-naphthol EO adducts, polyoxyethylene lauryl ether sulfates, and alkyl diphenyl ether disulfonates;
(iii) benzoic acid and its salts; and
(iv) aromatic compounds that are at least one selected from ortho-chlorobenzaldehyde and benzalacetone.

(XII) A plating method using the plating solution according to any one of Aspects (I) to (XI).

(XIII) A method for manufacturing a plated product using the plating solution according to any one of Aspects (I) to (XI).

Advantageous Effects of Invention

As described above, the plating solution of the present invention according to an embodiment contains an amine compound represented by $H_2N—R1-R2$. This amine compound can form a complex with a nickel ion and thereby can restrain deposition of nickel hydroxide. Accordingly, it is possible to regulate the ratio of nickel in a plating film and to provide plating having excellent corrosion resistance and adhesion.

DESCRIPTION OF EMBODIMENTS

More specific embodiments for implementing the present invention will now be described in detail.

0. Proportion of Nickel in Zinc-Nickel Alloy Film (Deposition Rate)

The plating solution of the present invention according to an embodiment contains zinc ions and nickel ions. The plating solution is more preferably a zinc-nickel alloy plating solution, and most preferably a zinc-nickel binary alloy plating solution. Appropriate adjustment of the proportion of nickel in a zinc-nickel alloy film is important to achieve high corrosion resistance and adhesion. The theoretical deposition rate of nickel in Zn—Ni alloy plating of a γ single layer is about 12% to about 18% by mass. Substantially, however, high corrosion resistance and adhesion can be achieved even if the deposition rate is somewhat broader than this range. For example, even if the deposition rate is about 11% to about 19% by mass, high corrosion resistance and adhesion can be achieved.

1. Electroplating Solution 1-1. pH

The plating solution of the present invention according to an embodiment is an acid plating solution, more typically, may be a weak acid plating solution. The specific range of pH may be about 4 to about 6. More preferably, the range may be about 5.4 to about 5.8. Herein, when the pH is less than 4, the deposition rate of nickel at a low current density portion is higher than the above-mentioned desired range. When the pH is higher than 6, salts of zinc and nickel disadvantageously precipitate.

1-2. Zinc Ion

The plating solution of the present invention according to an embodiment contains zinc ions. The source of supplying zinc ions can be at least one selected from, for example, zinc chloride, zinc sulfate, and zinc of the anode, but is not limited thereto. Typically, zinc chloride can be used. The total content of zinc ions in the plating solution may be about 10 to about 60 g/L as zinc ion itself and more preferably about 20 to about 40 g/L. A content of zinc ions of less than 10 g/L gives a reduced thickness of the plating film and a nickel deposition rate higher than the above-mentioned desired range to undesirably cause a significant reduction in corrosion resistance. A content of zinc ions of higher than 60 g/L gives a nickel deposition rate of the plating film lower than the above-mentioned desired range to undesirably cause a significant reduction in corrosion resistance.

1-3. Nickel Ion

The plating solution of the present invention according to an embodiment contains nickel ions. The source of supplying nickel ions can be at least one selected from, for example, nickel chloride, nickel sulfate, nickel carbonate, nickel acetate, and nickel of the anode, but is not limited thereto. Typically, nickel chloride can be used. The total content of nickel ions in the plating solution may be about 10 to about 60 g/L as nickel ion itself and more preferably about 20 to about 40 g/L. A content of nickel ions less than 10 g/L gives a reduced thickness of the plating film and a nickel deposition rate lower than the above-mentioned desired range to undesirably cause a significant reduction in corrosion resistance. A content of nickel ions of higher than 60 g/L give a nickel deposition rate of the plating film higher than the above-mentioned desired range to undesirably cause a significant reduction in corrosion resistance.

1-4. Electroconductive Salt

The plating solution of the present invention according to an embodiment contains at least one electroconductive salt for providing an electrical conductive property, in addition to the zinc ion supply source, the nickel ion supply source, and a pH buffering agent described below. A particularly preferable electroconductive salt is potassium chloride and/or ammonium chloride, but is not limited thereto. The total content of the electroconductive salt in the plating solution can be about 100 to about 280 g/L and may be more preferably about 160 to about 240 g/L. A content of less than 100 g/L is undesirable because plating is not deposited at a low current density portion. A content of higher than 280 g/L is undesirable because, for example, a natural organic compound, such as gelatin or peptone, or a polyoxyethylene polyoxypropylene block polymer for providing gloss is hardly dissolved in the plating solution.

1-5. pH Buffering Agent

The plating solution of the present invention according to an embodiment contains at least one pH buffering agent for providing a pH buffering property. It is preferable to use a pH buffering agent showing a buffering action in a pH range of typically 3 to 7 and more specifically 4 to 6. The pH buffering agent can be at least one selected from the group consisting of boric acid, acetic acid, citric acid, ascorbic acid, and tartaric acid; ammonium salts, sodium salts, and potassium salts of these acids; ammonium chloride; and ammonium sulfate, but is not limited thereto. The total content of the pH buffering agent in the plating solution can be about 5 to about 55 g/L and may be more preferably about 20 to about 50 g/L. A content of less than about 5 g/L causes deposition of hydroxide of zinc or nickel at a high current density portion, resulting in abnormal plating. A content of higher than 55 g/L exceeds the solubility to undesirably cause precipitation.

1-6. Brightening Agent and/or Smoothing Agent

The plating solution of the present invention according to an embodiment may contain at least one of the following additives for providing glossiness and/or smoothness, in addition to the above-described components.

1-6-1. Natural Organic Compound

The plating solution of the present invention according to an embodiment can contain some natural organic compounds for providing glossiness and/or smoothness. For example, the plating solution can contain natural organic compounds that are at least one selected from gelatin, glue, and peptone, but the natural organic compounds are not limited thereto. The total content of the natural organic compounds in the plating solution is about 1 to about 50 g/L and may be more preferably about 2 to about 10 g/L. A content of less than 1 g/L cannot provide smooth plating, resulting in abnormal plating. A content of higher than 50 g/L cannot sufficiently dissolve (for example, gelatin or peptone cannot sufficiently dissolve), resulting in meaningless addition.

1-6-2. Surfactant

The plating solution of the present invention according to an embodiment can contain some surfactants for providing glossiness and/or smoothness. For example, the plating solution can contain at least one nonionic surfactant selected from polyoxyethylene polyoxypropylene block polymers, alkyl naphthalene EO adducts, acetylene glycol EO adducts, and β-naphthol EO adducts, but the surfactants are not limited thereto. Alternatively, the plating solution can contain an ionic surfactant, such as a polyoxyethylene lauryl ether sulfate or an alkyl diphenyl ether disulfonate, but the surfactant is not limited thereto. The total content of the surfactants in the plating solution can be about 1 to about 50 g/L and may be more preferably about 1.5 to about 10 g/L. A content of less than 1 g/L cannot sufficiently dissolve gelatin and peptone and therefore cannot provide smooth plating, resulting in abnormal plating. When the content is higher than 50 g/L, the surfactant itself cannot be sufficiently dissolved, resulting in meaningless addition.

1-6-3. Benzoic Acid and its Salt

The plating solution of the present invention according to an embodiment can contain benzoic acid or its salt for providing glossiness and/or smoothness. In particular, these compounds have an effect of uniform gloss plating at a low current density portion. The total content of benzoic acid or its salt in the plating solution can be about 0 to about 20 g/L and may be more preferably about 0.5 to about 5 g/L. A content of higher than 20 g/L undesirably decreases the clouding point of the plating solution. Benzoic acid or its salt may not be added when it is not needed.

1-6-4. Aromatic Compound

The plating solution of the present invention according to an embodiment can contain some aromatic compounds for providing glossiness and/or smoothness, in addition to benzoic acid. For example, the plating solution can contain at least one aromatic compound selected from ortho-chlorobenzaldehyde and benzalacetone, but the aromatic compound is not limited thereto. The total content of the aromatic compound in the plating solution can be about 0 to about 0.5 g/L and may be more preferably about 0.01 to about 0.5 g/L and most preferably about 0.02 to about 0.1 g/L. The aromatic compound may not be added to the plating solution, provided that the resulting plating film without using the aromatic compound has no problem in its use. A content of higher than 0.5 g/L does not improve the gloss of the plating film any more and undesirably increases adverse effects such as a reduction in the thickness of the plating film.

1-7. Amine Compound

The plating solution of the present invention according to an embodiment can contain at least one amine compound represented by the following Formula:

$$H_2N—R1-R2$$

where

R1 represents $[(CH_2)_M—NH]_L$ or $(CH_2)_N$;

R2 represents H, $NH_2$, or R3;

R3 represents an alkanol or alkoxyl group having 1, 2, 3, 4, or 5 carbon atoms;

L is 2, 3, 4, or 5;

M is 2, 3, 4, or 5; and

N is 3, 4, or 5.

In the amine compound of an embodiment, R1 may be $[(CH_2)_M—NH]_L$.

In the amine compound in an embodiment, R1 may be $(CH_2)_N$.

The total content of the amine compound can be about 5 to about 50 g/L and may be more preferably about 10 to about 30 g/L. A content of less than about 5 g/L has a risk of reducing the effects of the present invention. In contrast, the effect of the present invention reaches a plateau when the content is higher than about 50 g/L, and is therefore undesirable in the light of cost.

Examples of the amine compound include, but is not limited to, propylamine, butylamine, diethylenetriamine, triethylenetetramine, and tetraethylenepentamine; and hydroxyethanol (EO) adducts, hydroxypropanol (PO) adducts, and ethoxy adducts of these amines.

2. Electroplating Condition 2-1. Current Density

The plating solution of the present invention according to an embodiment is compatible to a wide range of current density for electroplating. Typically, electroplating can be performed in a range of about 2 to about 5 A/dm$^2$ or in a range of about 5 to about 10 A/dm$^2$. A current density of less than 2 A/dm$^2$ causes a problem of a reduction in plating rate as described above.

2-2. Temperature

The temperature range is not particularly limited and is typically about 20° C. to about 50° C. and further typically about 30° C. to about 40° C.

3. Others (Plating Target Material)

A plating method can be performed using the plating solution of the present invention according to an embodiment, and a plated product can be produced by the method. Herein, the plating target material is not particularly limited. Typically, however, steel parts or materials can be plated using the plating solution of the present invention according to an embodiment. In particular, the present invention is very useful for steel parts or materials that are required to have excellent corrosion resistance, such as automobile parts and construction materials. The rust resistant effects of the parts or materials are increased, which extremely elongates the periods of use thereof and gives industrially useful results.

Examples

Examples for showing the effects of the present invention will now be described in detail.

1. Acid Bath and Alkali Bath for Comparison

Acid baths and an alkali bath for comparison having the compositions shown in Tables 1 and 2 were prepared. To these baths was added each amine compound at a predetermined amount (or not added) to prepare the electroplating solutions of Examples 1 to 7 and Comparative Examples 1 to 4.

TABLE 1

| | Acid bath 1 | | Acid bath 2 | | Acid bath 3 | |
|---|---|---|---|---|---|---|
| Metal salts | Anhydrous zinc chloride (zinc ion) | 50 g/L (24.0 g/L) | Zinc chloride (zinc ion) | 50 g/L (24.0 g/L) | Zinc chloride (zinc ion) | 60 g/L (28.8 g/L) |
| | Nickel chloride hexahydrate (nickel ion) | 100 g/L (24.7 g/L) | Nickel sulfate heptahydrate (nickel ion) | 90 g/L (18.8 g/L) | Nickel chloride hexahydrate (nickel ion) | 100 g/L (24.7 g/L) |
| | Potassium chloride | 200 g/L | Ammonium chloride | 200 g/L | Potassium chloride | 250 g/L |
| | pH | 4.7 | pH | 5.3 | pH | 5.5 |
| pH buffering agent | Boric acid | 20 g/L | — | — | — | — |
| | Sodium acetate | 35 g/L | Sodium citrate | 50 g/L | Ammonium acetate | 30 g/L |
| Gloss agent | Peptone | 5 g/L | Peptone | 1 g/L | Peptone | 2 g/L |
| | Pluronic F68*1 | 1 g/L | Surfynol 485*2 | 1 g/L | Lugalvan BNO12*5 | 2 g/L |
| | Emal 20C*3 | 0.5 g/L | Sanded AL*4 | 2 g/L | — | — |
| | — | | Sodium benzoate | 0.5 g/L | — | — |
| | — | | ortho-chlorobenzaldehyde (1% ethanol solution) | 1 g/L | benzalacetone (1% ethanol solution) | 1 g/L |

Pluronic F68*1: manufactured by ADEKA Corporation, PEG/PPG-160/30 copolymer
Surfynol 485*2: manufactured by Air Products and Chemicals Inc., acetylene glycol EO adduct
Emal 2OC*3: manufactured by Kao Corporation, sodium polyoxyethylene lauryl ether sulfate
Sanded AL*4: manufactured by Sanyo Chemical Industries, Ltd., sodium alkyl diphenyl ether disulfonate
Lugalvan BNO12*5: manufactured by BASF, β-naphthol EO adduct (EO, 12 mol)

TABLE 2

| | | Alkali bath for comparison*1 (ZN-204 manufactured by Nippon Hyomen Kagaku K.K.) |
|---|---|---|
| Metal salts | Metal zinc | 9 g/L |
| | Metal nickel | 1.45 g/L |
| | Sodium hydroxide | 130 g/L |
| Nickel complexing agent | High Ni Zinc ZN-HT | 180 g/L |
| Gloss agent | High Ni Zinc ZN-204AM | 4 mL/L |

*1a pH of 13 or more (because of a large amount of sodium hydroxide contained therein, actual measurement of the pH is difficult.)

2. Pre-Plating Treatment

An article to be plated was immersed in an aqueous solution containing 50 g/L of an alkali degreasing agent (1 M115, manufactured by Nippon Hyomen Kagaku K.K.) heated to 50° C. for 5 minutes. The surface was then rinsed with water and wiped with clean cotton cloth. The article to be plated was immersed in a 20% aqueous solution of 35% hydrochloric acid for 5 minutes and was rinsed with water. Immediately after the rinsing, the article to be plated was immersed in a plating tank and was plated.

3. Plating Method

An acrylic square container of 100 mm×150 mm×200 mm (liquid amount: 2.5 L) was used as a plating tank, and an spcc-sb square iron plate of 100 mm×50 mm×1 mm (1 dm$^2$ in both surfaces) was plated at 10 A, 5 A, 2 A, or 1 A for 10 minutes at 35° C.

4. Post-Plating Treatment

The plate after the completion of plating was rinsed with running water. Immediately after the rinsing with running water, the plate was rinsed with water, was immersed in a trivalent chromium chemical conversion coating film treatment agent, ZNC-988 (ZNC-988A: 100 mL/L, ZNC-988C: 75 mL/L) manufactured by Nippon Hyomen Kagaku K.K., for zinc-nickel alloy plating at 30° C. for 40 seconds with stirring, was rinsed with running water, and was then hot-air-dried at 60° C. for 5 minutes.

5. Method of Evaluation after Plating

The plating appearance was investigated 24 hours after the above-described treatment. When peeling of the plating film from the material metal (iron) was visually observed, it was determined as "adhesion failure". When peeling was not observed, it was determined as "good". The thickness of the plating film and the deposition rate of nickel were measured with an X-ray fluorescent analysis thickness meter (model: FISCHERSCOPE X-RAY XDLM) manufactured by Fischer Instruments K.K. The central portion of the plated article was used for the measurement. Some plated articles (2A-10 min plating article) was evaluated for the corrosion resistance by a neutral salt spray test in accordance with JIS Z 2371.

6. Results

TABLE 3

| | | Example 1 | Example 2 | Example 3 | Example 4 | Example 5 | Example 6 | Example 7 |
|---|---|---|---|---|---|---|---|---|
| Bath used | | Acid bath 1 | Acid bath 1 | Acid bath 2 | Acid bath 2 | Acid bath 3 | Acid bath 3 | Acid bath 3 |
| Amine, amine compound | | Diethylene triamine (30 g/L) | Triethylene triamine (30 g/L) | Propyl-amine (10 g/L) | Butylamine (10 g/L) | 3-Ethoxy-propylamine (15 g/L) | Hydroxy-ethanol diethylene triamine (10 g/L) | Hydroxy-propanol diethylene triamine (10 g/L) |
| Nickel deposition rate (% by mass) | 10A-10 min plating | 17.4% | 17.8% | 18.7% | 13.0% | 17.9% | 16.6% | 17.8% |
| | 5A-10 min plating | 17.7% | 18.0% | 13.3% | 11.9% | 16.8% | 16.7% | 16.9% |
| | 2A-10 min plating | 17.9% | 18.0% | 12.2% | 12.0% | 16.5% | 16.8% | 14.8% |
| | 1A-10 min plating | 14.1% | 16.2% | 11.0% | 12.1% | 15.8% | 16.4% | 12.2% |
| Plating thickness (μm) | 10A-10 min plating | 23.2 μm | 23.3 μm | 21.1 μm | 18.8 μm | 19.9 μm | 22.8 μm | 19.7 μm |
| | 5A-10 min plating | 11.7 μm | 11.5 μm | 10.8 μm | 9.7 μm | 10.3 μm | 11.2 μm | 10.9 μm |
| | 2A-10 min plating | 5.3 μm | 4.8 μm | 4.3 μm | 4.1 μm | 5.1 μm | 4.4 μm | 3.9 μm |
| | 1A-10 min plating | 2.7 μm | 2.5 μm | 2.3 μm | 1.9 μm | 2.4 μm | 2.5 μm | 2.2 μm |
| 2A-10 min plated product, Results of salt water spray test | White rust occurrence time | 240 hr | 216 hr | 192 hr | 192 hr | 216 hr | 240 hr | 192 hr |
| | Red rust occurrence time | 1008 hr or more | 1008 hr or more | 1008 hr or more | 1008 hr or more | 1008 hr or more | 1008 hr or more | 1008 hr or more |

| | | Example 8 | Example 9 | Example 10 | Example 11 |
|---|---|---|---|---|---|
| Bath used | | Acid bath 3 | Acid bath 3 | Acid bath 3 | Acid bath 3 |
| Amine, amine compound | | Diethylene triamine (5 g/L) | Triethylene tetramine (50 g/L) | Propylamino-propanol (10 g/L) | Butylamine ethanol (10 g/L) |
| Nickel deposition rate (% by mass) | 10A-10 min plating | 18.2% | 15.8% | 17.8% | 13.7% |
| | 5A-10 min plating | 17.9% | 16.3% | 12.9% | 12.2% |
| | 2A-10 min plating | 13.4% | 14.6% | 12.1% | 12.0% |
| | 1A-10 min plating | 12.1% | 13.5% | 11.6% | 11.5% |
| Plating thickness (μm) | 10A-10 min plating | 23.3 μm | 17.9 μm | 19.6 μm | 20.1 μm |
| | 5A-10 min plating | 11.2 μm | 10.5 μm | 8.8 μm | 10.5 μm |
| | 2A-10 min plating | 4.2 μm | 4.7 μm | 3.9 μm | 4.4 μm |
| | 1A-10 min plating | 2.2 μm | 2.1 μm | 1.9 μm | 2.0 μm |
| 2A-10 min plated product, | White rust occurrence time | 192 hr | 216 hr | 216 hr | 192 hr |

TABLE 3-continued

| | | | | | | |
|---|---|---|---|---|---|---|
| | Results of salt water spray test | Red rust occurrence time | 1008 hr or more | 1008 hr or more | 1008 hr or more | 1008 hr or more |

TABLE 4

| | | Comparative Example 1 | Comparative Example 2 | Comparative Example 3 | Comparative Example 4 |
|---|---|---|---|---|---|
| Bath used | | Acid bath 1 | Acid bath 1 | Acid bath 2 | Alkali bath for comparison |
| Amine, amine compound | | — | Ethylene diamine (30 g/L) | Triethanol amine (10 g/L) | — |
| Nickel deposition rate (% by mass) | 10A-10 min plating | 23.3% | 27.5% | 23.0% | 16.0% |
| | 5A-10 min plating | 19.8% | 27.7% | 21.5% | 15.5% |
| | 2A-10 min plating | 18.1% | 27.8% | 18.5% | 15.4% |
| | 1A-10 min plating | 17.5% | 26.8% | 14.0% | 14.3% |
| Plating thickness (μm) | 10A-10 min plating | 24.1 μm | 25.3 μm | 19.9 μm | 5.8 μm |
| | 5A-10 min plating | 11.9 μm | 11.7 μm | 10.2 μm | 3.2 μm |
| | 2A-10 min plating | 5.0 μm | 5.1 μm | 4.8 μm | 1.9 μm |
| | 1A-10 min plating | 2.9 μm | 2.7 μm | 2.2 μm | 1.1 μm |
| 2A-10 min plated product, Results of salt water spray test | White rust occurrence time | 72 hr | 24 hr | 72 hr | 192 hr |
| | Red rust occurrence time | 120 hr | 72 hr | 144 hr | 720 hr |

TABLE 5

| | | Example 1 | Example 2 | Example 3 | Example 4 | Example 5 | Example 6 | Example 7 |
|---|---|---|---|---|---|---|---|---|
| Bath used | | Acid bath 1 | Acid bath 1 | Acid bath 2 | Acid bath 2 | Acid bath 3 | Acid bath 3 | Acid bath 3 |
| Amine, amine compound | | Diethylene triamine (30 g/L) | Triethylene tetramine (30 g/L) | Propyl-amine (10 g/L) | Butylamine (10 g/L) | 3-Ethoxy-propylamine (15 g/L) | Hydroxy-ethanol diethylene triamine (10 g/L) | Hydroxy-propanol diethylene triamine (10 g/L) |
| Adhesion | 10A-10 min plating | Good | Good | Good | Good | Good | Good | Good |
| | 5A-10 min plating | Good | Good | Good | Good | Good | Good | Good |
| | 2A-10 min plating | Good | Good | Good | Good | Good | Good | Good |
| | 1A-10 min plating | Good | Good | Good | Good | Good | Good | Good |

| | Example 8 | Example 9 | Example 10 | Example 11 |
|---|---|---|---|---|
| Bath used | Acid bath 3 | Acid bath 3 | Acid bath 3 | Acid bath 3 |
| Amine, amine compound | Diethylene triamine (5 g/L) | Triethylene tetramine (50 g/L) | Propylamino-propanol (10 g/L) | Butylamine ethanol (10 g/L) |

TABLE 5-continued

| | | | | | |
|---|---|---|---|---|---|
| Adhesion | 10 A-10 min plating | Good | Good | Good | Good |
| | 5A-10 min plating | Good | Good | Good | Good |
| | 2A-10 min plating | Good | Good | Good | Good |
| | 1A-10 min plating | Good | Good | Good | Good |

TABLE 6

| | | Comparative Example 1 | Comparative Example 2 | Comparative Example 3 | Comparative Example 4 |
|---|---|---|---|---|---|
| Bath used | | Acid bath 1 | Acid bath 1 | Acid bath 2 | Alkali bath for comparison |
| Amine, amine compound | | — | Ethylene diamine (30 g/L) | Triethanol amine (10 g/L) | — |
| Adhesion | 10A-10 min plating | Adhesion failure | Adhesion failure | Adhesion failure | Good |
| | 5A-10 min plating | Adhesion failure | Adhesion failure | Adhesion failure | Good |
| | 2A-10 min plating | Good | Good | Good | Good |
| | 1A-10 min plating | Good | Good | Good | Good |

As described by Examples above, the weak acid bath containing amines of the present invention provided a zinc-nickel alloy plating film having excellent corrosion resistance at a plating rate two times or more than that in the use of existent alkali baths. In addition, the plating film formed from the plating solution of the present invention had remarkably excellent corrosion resistance compared with a plating film not containing the amines.

As shown by Comparative Examples 2 and 3, in other amines, good adhesion was not obtained, and the corrosion resistance was also low. Although the scope of the present invention is not intended to be limited by the theory described below, it is thought that the complexes of nickel coordinated by the amines of Comparative Examples readily form hydroxide of nickel in the process of reduction to nickel metal, compared to the complexes coordinated by the amines of the present invention.

INDUSTRIAL APPLICABILITY

Application of the plating solution of the present invention to steel parts or materials that are required to have excellent corrosion resistance, such as automobile parts and construction materials, can increase the rust resistant effect of the parts or materials, which extremely elongates the periods of use thereof and gives industrially useful results.

What is claimed is:

1. An acidic zinc-nickel binary alloy electroplating solution, the electroplating solution comprising:

(1) a zinc ion;

(2) a nickel ion;

(3) an electroconductive salt;

(4) a pH buffering agent; and (5) an amine compound represented by the following formula:

$H_2N—R1-R2$ where,

R1 represents $[(CH_2)_M—NH]_L$ or $(CH_2)_N$;

R2 represents R3;

R3 represents an alkanol or alkoxyl group having 1, 2, 3, 4, or 5 carbon atoms;

L is 2, 3, 4, or 5;

M is 2, 3, 4, or 5; and

N is 3, 4, or 5, wherein the electroplating solution can form a zinc-nickel binary alloy layer.

2. The electroplating solution according to claim 1, wherein the electroplating solution has a pH of 4 to 6.

3. The electroplating solution according to claim 1, wherein a total content of the amine compound is 5 g/L to 50 g/L.

4. The electroplating solution according to claim 1, wherein R1 represents $[(CH_2)_M—NH]_L$.

5. The electroplating solution according to claim 1, wherein R1 represents $(CH_2)_N$.

6. The electroplating solution according to claim 1, wherein the amine compound is at least one selected from the group consisting of an hydroxyethanol adduct of an alkyl amine compound, a hydroxypropanol adduct of an alkyl amine compound, and an ethoxy adduct of an alkyl amine compound, wherein the alkyl amine compound is selected from the group consisting of propylamine, butylamine, diethylenetriamine, triethylenetetramine, and tetraethylenepentamine.

7. The electroplating solution according to claim 1, wherein a total content of the zinc ion is 10 g/L to 60 g/L, and a total content of the nickel ion is 10 g/L to 60 g/L.

8. The electroplating solution according to claim 1, wherein a total content of the electroconductive salt is 100 g/L to 280 g/L, and the electroconductive salt is potassium chloride and/or ammonium chloride.

9. The electroplating solution according to claim 1, wherein a total content of the pH buffering agent is 5 g/L to 55 g/L, and the pH buffering agent is at least one selected from the group consisting of boric acid, acetic acid, citric acid, ascorbic acid, tartaric acid; ammonium salts thereof, sodium salts thereof, and potassium salts thereof.

10. The electroplating solution according to claim 1, further comprising a brightening agent and/or a smoothing agent.

11. The plating electroplating solution according to claim 10, wherein the brightening agent and/or smoothing agent is at least one compound selected from the group consisting of:

(i) natural organic compounds that are at least one selected from the group consisting of gelatin, glue, and peptone;

(ii) surfactants that are at least one selected from the group consisting of polyoxyethylene polyoxypropylene block polymers, alkyl naphthalene EO adducts, β-naphthol EO adducts, polyoxyethylene lauryl ether sulfates, and alkyl diphenyl ether disulfonates;

(iii) benzoic acid and its salts; and (iv) aromatic compounds that are at least one selected from the group consisting of ortho-chlorobenzaldehyde and benzalacetone.

12. An electroplating method comprising a step of electroplating with said electroplating solution according to claim 1.

13. A method for manufacturing an electroplated product, the method comprising a step of electroplating with said electroplating solution according to claim 1.

14. The electroplating solution according to claim 1, wherein R3 represents an alkoxyl group having 1, 2, 3, 4, or 5 carbon atoms.

* * * * *